US005386617A

United States Patent [19]

Gorza et al.

[11] Patent Number: 5,386,617

[45] Date of Patent: Feb. 7, 1995

[54] CLOSURE LEVER, PARTICULARLY FOR SPORTS SHOES

[75] Inventors: Roberto Gorza, Feltre; Renato Serafin, Vedelago; Mirco Battistella, Spresiano, all of Italy

[73] Assignee: Nordica S.p.A., Trevignano, Italy

[21] Appl. No.: 121,488

[22] Filed: Sep. 16, 1993

[30] Foreign Application Priority Data

Sep. 23, 1992 [IT] Italy ..... TV92A000103

[51] Int. Cl.[6] ..... A43C 11/00

[52] U.S. Cl. ..... 24/68 SK

[58] Field of Search ..... 24/68 SK, 69 SK, 70 SK, 24/71 SK

[56] References Cited

U.S. PATENT DOCUMENTS 4,893,384 1/1990 Bidoia et al. ..... 24/68 SK

FOREIGN PATENT DOCUMENTS 1356463 2/1964 France .
2016687 5/1970 France .
2507445 12/1982 France .
2543411 10/1984 France .

*Primary Examiner*—James R. Brittain
*Attorney, Agent, or Firm*—Guido Modiano; Albert Josif; Daniel O'Byrne

[57] ABSTRACT

Closure lever, particularly usable for sports shoes such as ski boots, ice skates and roller skates etc., including three elements: a hollow body, a threaded pivot with which a traction element is associable, and a knob. The knob is temporarily rotatably associable with the hollow body without requiring coupling pins or rivets. The lever obtained is very simple, easy to industrialize and relatively low in cost.

16 Claims, 3 Drawing Sheets

CLOSURE LEVER, PARTICULARLY FOR SPORTS SHOES

BACKGROUND OF THE INVENTION

The present invention relates to a closure lever particularly for sports shoes such as ski boots, roller skates or ice skates, etc.

Several types of lever are currently known. Conventional levers are constituted by a lever arm, which is pivoted at one end at adapted shoulders associated with a flap of an upper or of a shell, and has an adapted toothed surface with which the end of a cable interacts. The other end of the cable is associated with the second flap of the item of footgear.

These conventional levers do not allow to obtain micrometric adjustment of the useful length of the cable.

As a partial solution to this drawback, levers are known which have, at their lever arm, means for micrometric adjustment of the tension of the cable. For example, U.S. Pat. No. 4,553,292, discloses a quick closure means for ski boots which comprises a lever arm with which a screw is associated along a longitudinal axis. A sleeve, is coaxially associated with the screw, and its position is steplessly adjustable in a longitudinal direction; a coupling element movable with respect to the screw stem interacts with said sleeve during the tightening of a cable.

However, this solution is structurally complicated, being constituted by several component elements that must be assembled in a specific order.

As a partial solution to the described drawbacks, this same Assignee filed a U.S. patent application Ser. No. 06/297.811 on Aug. 31, 1981, related to a closure device for ski boots which comprises a lever element pivoted at one end at one of the flaps to be secured; one end of a traction element is furthermore articulated to a median portion of the lever element, and the other end is provided with a hook-like element coupleable in engagement seats formed at the other flap to be secured.

The peculiarity of the above invention is that the traction element is provided with means for adjusting its working length and with at least one substantially flexible portion; said means is constituted by a threaded pawl associated with one end of said flexible cable and rotatably engaging a threaded cavity formed at one end of said rigid bar, and by a grub screw provided at the other end and rotatably engaging a threaded seat formed in the hook-like element.

Even this solution, however, has drawbacks which essentially concern structural complexity, due to the considerable number of elements used, and the need to use connecting rivets or pivots, thus increasing the manufacturing costs of the device.

Furthermore, in order to adjust the useful length of the cable it is necessary to disengage the hook from the openings formed on the block, and once adjustment has been achieved it is necessary to re-associate the hook with the openings.

SUMMARY OF THE INVENTION

The aim of the present invention is therefore to provide a lever which is structurally very simple and has very low manufacturing costs.

Within the scope of the above aim, another important object is to provide a lever comprising a low number of component elements which can be easily and quickly assembled together without requiring specific tools.

Another important object is to provide a lever in which the components whereof can be easily and rapidly disassembled for possible replacement.

Another object is to provide a lever allowing micrometric adjustment of the working length of a tightening element such as a cable.

Another object is to provide a lever which has small dimensions, allows easy adjustment of the tightening degree of the traction element and is easily activatable by the user.

This aim, these objects and others which will become apparent hereinafter are achieved by a closure lever, particularly for sports shoes, characterized in that it comprises a hollow body with which a pivot member is axially associated, said pivot having, at one end, engagement means for at least one traction element and, at the other end, engagement means for a knob which is rotatably associable with said body, said body having at least one seat for a complementarily shaped tab which is temporarily associable therewith and protrudes axially with respect to said knob.

Advantageously, the lever according to the present invention comprises means for limiting the stroke of the pivot within the hollow body.

BRIEF DESCRIPTION OF THE DRAWINGS

Further characteristics and advantages of the present invention will become apparent from the following detailed description of a particular but not exclusive embodiment thereof, illustrated only by way of non-limitative example in the accompanying drawings, wherein.

Figure 1:
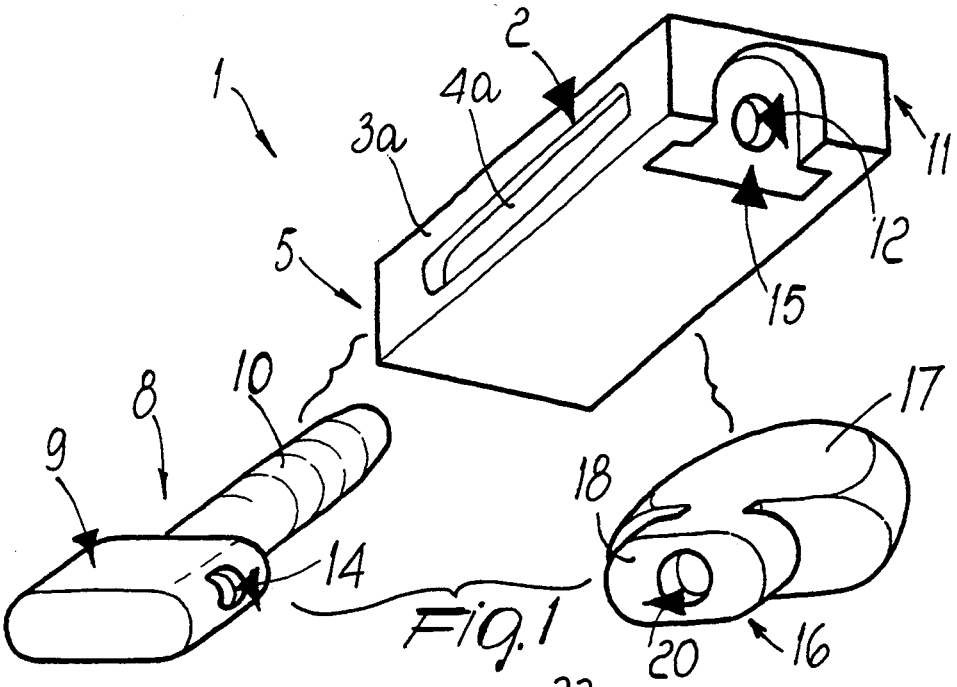
FIG. 1 is an exploded view of the lever according to the invention.
Figure 2:
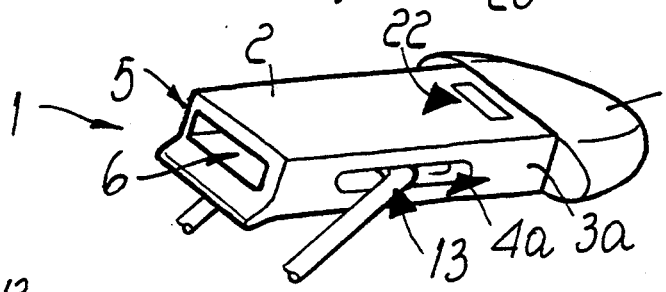
FIG. 2 is a perspective view of the lever.
Figure 4:
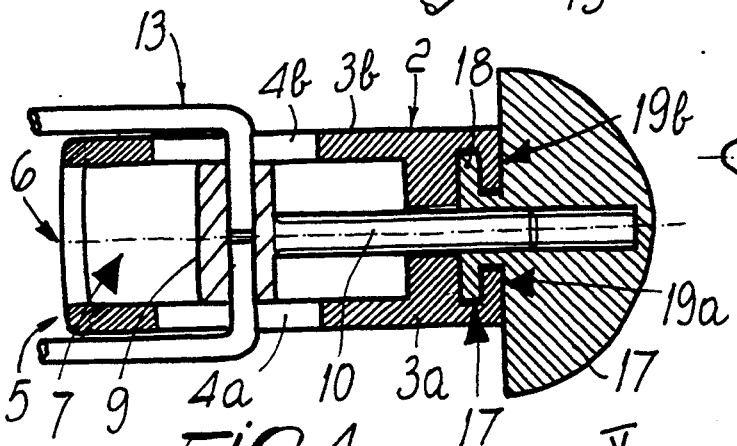
FIG. 4 is a sectional view, taken along the plane IV—IV of FIG. 3.
Figure 5:
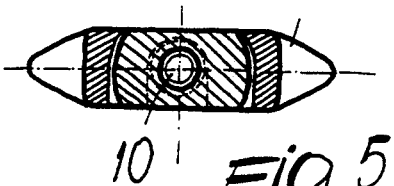
FIG. 5 is a sectional view, taken along the plane V—V of FIG. 3.
Figure 3:
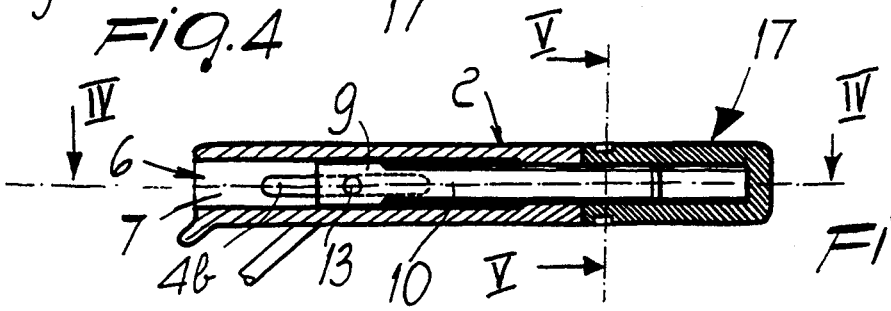
FIG. 3 is a sectional view, taken along a medium longitudinal plane, of the lever.
Figure 7:
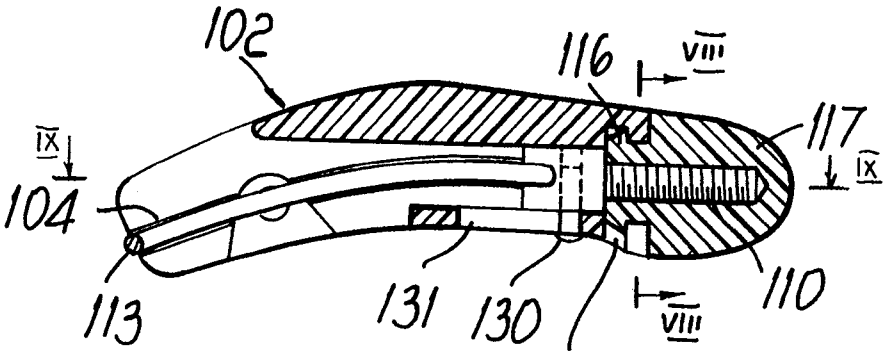
Figure 8:
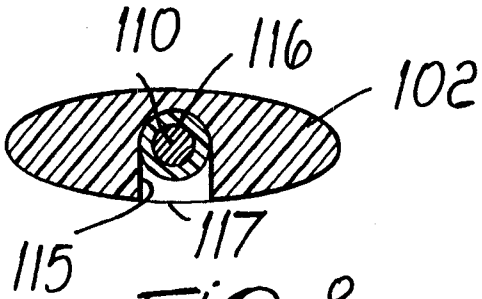
Figure 6:
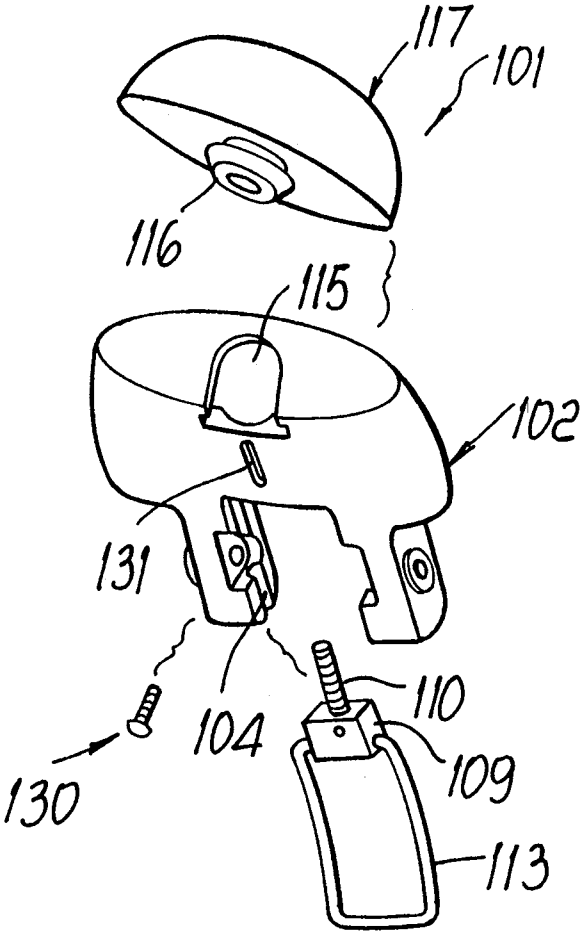
Figure 9:
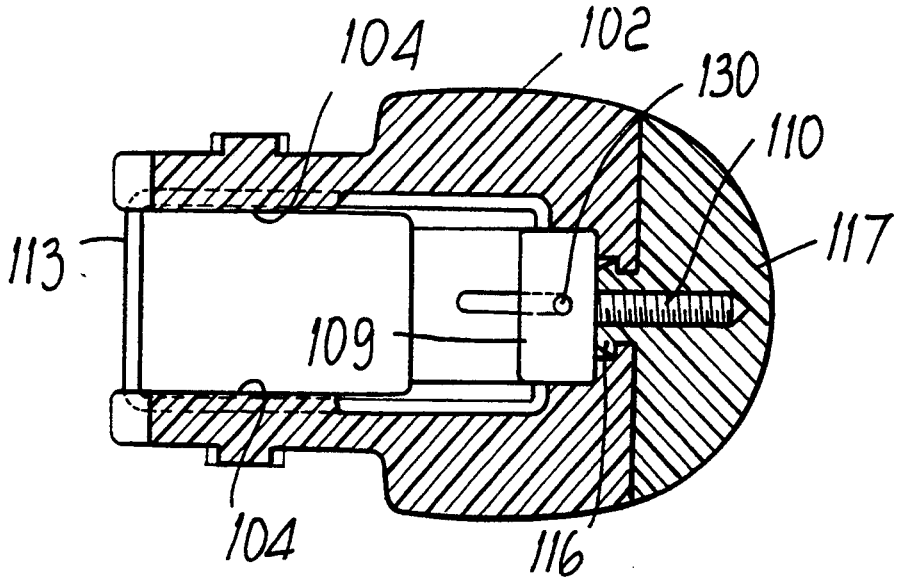
Figure 10:
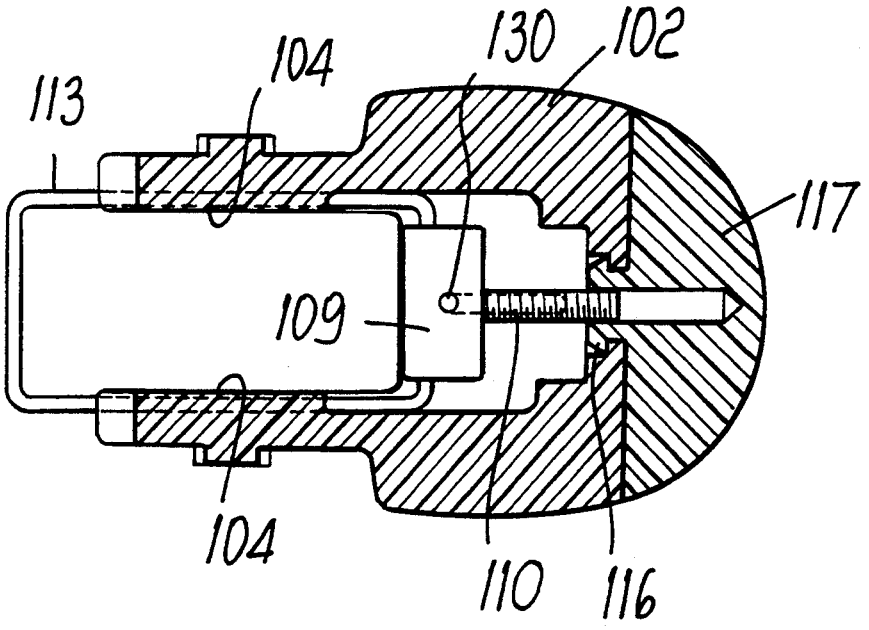

FIG, 6 is an exploded view of the lever according to a second aspect of the invention;

FIG. 7 is a side section view of the lever of FIG. 6;

FIG. 8 is a cross section view according to the plane VII—VIII of FIG. 7;

FIG. 9 is a top section view, according to the plane IX—IX Of FIG. 7, of the lever in the position of minimum adjustment;

FIG. 10 is a view similar to FIG. 9 showing the lever in the of the position of maximum adjustment.

DESCRIPTION OF THE PREFERRED EMBODIMENTS

With reference to the above figures, the reference numeral 1 designates a lever particularly usable for sports shoes, such as for example ski boots, ice skates or roller skates.

Said lever is constituted by a hollow body 2 which is essentially shaped like a parallelepiped. Said hollow body 2 has adapted longitudinal slots 4*a* and 4*b* at its longitudinal lateral surfaces 3*a* and 3*b*.

The hollow body 2 furthermore has, at its rear lateral surface 5, an opening 6 which is essentially rectangular and is connected to the inside of said hollow body 2.

A pivot 8 is furthermore axially associable within the cavity 7 formed in the hollow body 2 and has a head 9, which is shaped approximately complementarily to the cavity 7, and a threaded stem 10 protruding from the front lateral surface 11 of the hollow body 2 through an adapted first hole 12 formed therein.

Engagement means for at least one traction element 13, such as a metallic ring or one or more cables, are formed at the head 9 of the pivot 8; the ends of said traction element are arrangeable at an adapted first seat 14 formed transversely to said head 9 and constituting said engagement means.

Said first seat 14 is formed at the plane of arrangement of the longitudinal slots **4*a* and 4*b*, in order to allow the traction element 13 to extend outside of the hollow body 2**.

At least one second seat 15 for a complementarily shaped tab 16, which is formed at an end of a knob 17, is furthermore formed at the front lateral surface 11 of the hollow body 2.

Said tab 16 is essentially T-shaped in transverse cross-section, and its head 18 is rotatably retained within the second seat 15 by a pair of shoulders **19*a* and 19*b* formed on the front lateral surface 11 of the hollow body 2**.

The tab 16 furthermore has a second hole 20 formed axially in it and axially aligned with the first hole 12; said second hole 20 is internally threaded complementarily to the threaded stem 10 of the pivot 8.

Said threaded stem 10 constitutes the means for mutually engaging the pivot 8 with the knob 17.

The lever is thus essentially constituted by three components, such as the pivot 8, the hollow body 2 and the knob 17.

Assembly of these components entails the temporary association of the knob 17 with the hollow body 2, arranging the tab 16 within the second seat 15; in this manner the knob is connected to the hollow body but can rotate at the axis of the first hole 12 and of the second hole 20.

Since the tab 16 has an essentially ellipsoid plan shape with flattened surfaces, it is possible to provide, at the upper lateral surface 21 of the hollow body 2, an adapted opening 22 suitable to allow the rotation of the head 18 of the tab 16.

Then the pivot 8 is inserted into the cavity 7, connecting it to the knob 17 by rotating it, in order to mutually engage the threaded stem 10 with the thread of the second hole 20.

A traction element, such as a metallic ring, can then be placed with its ends in the first seat 14, or a cable can be passed within said seat.

Adjustment of the working length of the traction element can occur in a very rapid and easy manner, by rotating the knob 17 in the required direction.

A means for limiting the stroke of the pivot 8 is provided within the hollow body 2 in order to prevent its escape. Said means is constituted, in the described example, by the traction element 13 abutting against the ends of the slots **4*a* and 4*b***, which thus determine the adjustment stroke.

FIGS. 6–10 illustrate a lever 101 according to a second aspect of the invention, comprising a U-shaped body 102 having a seat 115. A T-shaped head 116 of a knob 117 is arranged in the seat 115.

The U-shaped body 102 comprises guides 104 and a ring, or traction element, 113 slides therein. The knob 117 is rotatably associated with a screw 110 which has a head 109. The traction element 113 is associated with the screw head 109.

A pin 130 is provided on the screw head 109 and is adapted to slide in a slot 131, formed on the body 102, to serve as a position indicator and a stop member, as the knob is turned to adjust the working length of the traction element 113.

It has thus been observed that the present invention has achieved the intended aim and objects, a lever having been obtained which comprises a limited number of components which can be rapidly and easily mutually assembled and are suitable to allow easy and rapid adjustment of the useful length of a traction element.

Its structural simplicity furthermore allows to contain the manufacturing costs of the lever.

The materials and the dimensions which constitute the individual components of the structure may also naturally be the most pertinent according to the specific requirements.

We claim:

1. Closure lever, particularly for sports shoes, comprising a hollow body with which a pivot member is axially associated, said pivot member having, at one end, engagement means for at least one traction element and, at the other end, engagement means for a knob which is rotatably associable with said body, said body having at least one seat for a complementarily shaped tab which is temporarily associable therewith and protrudes axially with respect to said knob wherein said hollow body has, at its rear lateral surface, a rectangular opening connected to a cavity formed inside said hollow body.

2. Lever according to claim 1, further comprising means for limiting the stroke of said pivot member within said hollow body.

3. Lever according to claim 2, wherein said traction element constitutes a means for limiting the stroke of said pivot member within said hollow body.

4. Lever according to claim 2, wherein said pivot member comprises a screw having a screw head, said screw head comprising a pin adapted to slide in a slot formed on said body.

5. Lever according to claim 1, wherein said hollow body is shaped like a parallelepiped and is provided with longitudinal slots at its longitudinal lateral surfaces.

6. Lever according to claim 1, wherein said pivot member is axially associable within said cavity and has a head shaped complementarily to said cavity and a threaded stem protruding from the front lateral surface of said hollow body through a first hole formed therein.

7. Lever according to claim 6, wherein engagement means for at least one traction element are provided at said head of said pivot member, said means being constituted by a first through seat formed transversely to said head.

8. Lever according to claim 7, wherein said first seat is formed at the plane of arrangement of said longitudinal slots.

9. Lever according to claim 1, wherein at least one second seat, for a complementarily shaped tab protruding axially from the end of a knob, is formed at the front lateral surface of said hollow body.

10. Lever according to claim 9, wherein said tab is T-shaped in transverse cross-section, the head of said tab being temporarily and rotatably arrangeable within said second seat and being retained by a pair of shoulders formed on the front lateral surface of said hollow body.

11. Lever according to claim 10, wherein said head of said tab has, in a plan view, a substantially elliptical shape, the wings of said head being able to affect, during rotation, an adapted opening formed on the upper surface of said hollow body at said second seat.

12. Lever according to claim 11, wherein said tab has a second hole formed at the axis of said first hole and internally threaded complementarily to said threaded stem of said pivot member, said threaded stem constituting a means for engaging said pivot with said knob.

13. Closure lever, particularly for sports shoes, comprising a hollow body with which a pivot member is axially associated, said pivot member having, at one end, engagement means for at least one traction element and, at the other end, engagement means for a knob which is rotatably associable with said body, said body having at least one seat for a complementarily shaped tab which is temporarily associable therewith and protrudes axially with respect to said knob, wherein at least one second seat, for a complementarily shaped tab protruding axially from the end of a knob, is formed at the front lateral surface of said hollow body, and wherein said tab is T-shaped in transverse cross-section, the head of said tab being temporarily and rotatably arrangeable within said second seat and being retained by a pair of shoulders formed on the front lateral surface of said hollow body.

14. Lever according to claim 13, wherein said head of said tab has, in a plan view, a substantially elliptical shape, the wings of said head being able to affect, during rotation, an adapted opening formed on the upper surface of said hollow body at said second seat.

15. Lever according to claim 14, wherein said tab has a second hole formed at the axis of said first hole and internally threaded complementarily to said threaded stem of said pivot member, said threaded stem constituting a means for engaging said pivot with said knob.

16. Closure lever, particularly for sports shoes, comprising a hollow body with which a pivot member is axially associated, said pivot member having, at one end, engagement means for at least one traction element and, at the other end, engagement means for a knob which is rotatably associable with said body, said body having at least one seat for a complementarily shaped tab which is temporarily associable therewith and protrudes axially with respect to said knob, the lever further comprising means for limiting the stroke of said pivot member within said hollow body, and wherein said pivot member comprises a screw having a screw head, said screw head comprising a pin adapted to slide in a slot formed on said body.

* * * * *